US008261760B2

(12) United States Patent
Chen et al.

(10) Patent No.: US 8,261,760 B2
(45) Date of Patent: Sep. 11, 2012

(54) CONTROL DEVICE ADAPTED FOR COLLAPSIBLE UMBRELLA

(75) Inventors: Tien-Cheng Chen, Xiamen (CN); Sun-Feng Sung, Xiamen (CN)

(73) Assignee: Xiamen Mingho Brothers MFG Co., Ltd., Xiamen, Fujian (CN)

( * ) Notice: Subject to any disclaimer, the term of this patent is extended or adjusted under 35 U.S.C. 154(b) by 423 days.

(21) Appl. No.: 12/618,745

(22) Filed: Nov. 15, 2009

(65) Prior Publication Data

US 2010/0275706 A1 Nov. 4, 2010

(30) Foreign Application Priority Data

May 4, 2009 (CN) ..... 2009 2 0138181
Jul. 23, 2009 (CN) ..... 2009 2 0139670

(51) Int. Cl.
*A45B 25/14* (2006.01)

(52) U.S. Cl. ..... 135/22; 135/24

(58) Field of Classification Search ..... 135/15.1, 135/22, 24, 25.4, 25.41, 20.3
See application file for complete search history.

(56) References Cited

U.S. PATENT DOCUMENTS

| | | | | |
|---|---|---|---|---|
| 5,088,512 | A * | 2/1992 | Chou et al. | 135/24 |
| 5,174,319 | A * | 12/1992 | Chou et al. | 135/20.3 |
| 6,196,243 | B1 * | 3/2001 | Chen | 135/22 |
| 6,684,893 | B2 * | 2/2004 | Kuo | 135/24 |
| 7,798,160 | B2 * | 9/2010 | Chen | 135/24 |
| 2002/0129842 | A1 * | 9/2002 | Chen | 135/24 |
| 2003/0089387 | A1 * | 5/2003 | Chen | 135/24 |
| 2009/0133729 | A1 * | 5/2009 | Chong | 135/20.3 |
| 2010/0116304 | A1 * | 5/2010 | Chen | 135/24 |
| 2010/0319739 | A1 * | 12/2010 | Chong | 135/24 |
| 2011/0226295 | A1 * | 9/2011 | Lo | 135/24 |
| 2011/0232707 | A1 * | 9/2011 | Wu et al. | 135/22 |

* cited by examiner

*Primary Examiner* — Noah Chandler Hawk

(57) ABSTRACT

A control device is applied to a base of an umbrella stem. A buckle sits in the base whose upper portion sets a controlling device controlled by the buckle and whose lower portion radially disposes a spool disk. The peripheral wall of the spool disk having ratchets defined thereon is embraced by a spool groove. Two ends of a spiral spring are respectively fixed to the base and the spool disk to generate an elastic force driving the spool disk's rotation. A shift block positioned under the base of the controlling device has a continuous torsion to contact the spool disk and clasp the ratchets. A disk cord provides one end fixed on the spool disk and wound around the spool groove and the other end penetrating the controlling device and the base to join an upper accommodation of the umbrella.

12 Claims, 6 Drawing Sheets

CONTROL DEVICE ADAPTED FOR COLLAPSIBLE UMBRELLA

BACKGROUND OF THE INVENTION

1. Field of the Invention

The present invention relates to an umbrella, in particular to a controlling device for an umbrella support applied to an auto open and close umbrella.

2. Description of the Related Art

Umbrellas are articles for daily use. Wherein, since the auto folding umbrellas are able to be automatically opened and closed, they are known for their using convenience and handy storage. Therefore, this kind of umbrella is popular.

The control parts that determine the operation of the open and close of the existing auto open and close umbrella mainly comprise a stem, a lower accommodation, a warhead, a cord spring, a base and a button received in the stem, and a propelling spring disposed in a support. In closing the umbrella, the support would be shortened for compressing the propelling spring, so that the warhead would retract to the base for the cord spring to buckle, and the umbrella is closed. During the closing, the propelling spring needs to store energy, so the support has to be retracted until the lower accommodation is entirely positioned within the stem, and a complete closing of the umbrella is achieved. However, a certain degree of force and positioning accuracy are needed while compressing the support. Thus, if the lower accommodation does not accurately engage with the stem in time of compressing, a speedy and powerful spreading of the umbrella would be led by the elasticity of the propelling spring when users loosen their grips. As a result, a potential danger exists while the umbrella is closed, and it is possible to hurt users.

SUMMARY OF THE INVENTION

Therefore, the object of the present invention is to provide an a controlling device for an auto open and close umbrella, by which the lower accommodation of which could stop at any position during closing for improving a closing safety.

The present invention in conformity with the present invention applies the following techniques:

Control device adapted for collapsible umbrella in time of closing would cooperate with a base of an umbrella stem. A buckle is pivotally inserted into the base. Characterized in that, a controlling device controlled by the buckle is mounted on a higher portion of the base, a spool disk that is longitudinally rotated along with the base is positioned on a inferior portion of the base. A plurality of ratchets are defined on a peripheral wall of the spool disk that is embraced by a spool groove. One end of a spiral spring is fixed on the base, and the other end thereof is fixed on the spool disk, so that an elastic driving force is generated to rotate the spool disk. A swiveling shift block is disposed on the base that is disposed below the controlling device. Wherein, the shift block is controlled by a torsion spring for continuously possessing a torsion to contact the spool disk and to engage with the ratchets of the spool disk. One end of a disk cord is fixed on the spool disk and wound around the spool groove of the spool disk, and the other end thereof passes through the controlling device and the base for connecting to an upper accommodation of the umbrella.

The controlling device includes a controller and an inner part; the controller is disposed within the higher portion of the base, and the inner part is pivotally disposed at a bottom of the controller, so that the buckle is inserted from a top of the controller to prop against the inner part, and an underside of the inner part flexibly props against the shift block.

An aperture is axially disposed on the higher portion of the base, the inferior portion of the base is formed as a fixing portion, and a spindle is longitudinal disposed thereon for the spool disk to mount.

A tail of the buckle connects to a main cord, a crown of the buckle is formed as a necking for a button to engage with, and a needle is onward and extensively formed at the crown of the buckle.

The controller adopts a tubular component, and a middle portion thereof is axially formed by a hollow pipe. A window is defined on a side wall of the controller for a button to insert and engage with the buckle, and a notch that thoroughly penetrates the other side wall of the controller is defined thereon for the disk cord to pass through.

An end section of the notch at the top of the controller is manufactured as a through notch that is in communication with the hollow pipe of the controller.

Two edges of the notch are constructed by curved surfaces.

A guiding slot is disposed at an under inner wall of the hollow pipe, and a guiding block is defined on an exterior wall of the inner part for fitting with the guiding slot.

The inner part adopts a tubular component flexibly disposed to fit with a lower part of the hollow pipe of the controller, and a side wall of the inner part further defines a long opening thereon.

The inner part is composed of a front body, a rear body, and a spring. The front body and the rear body are connected by the spring, thereby forming a middle portion capable of being longitudinal compressed and deformed. A long opening is radially defined on the front body.

The spool disk adopts a plate component that defines a middle sink and is pivotally disposed on a spindle that is protruded at an inferior portion of the base. The spiral spring is disposed in the middle sink of the spool disk. Two ends of the spiral spring are respectively installed on the spindle and a slot wall of the middle sink of the spool disk.

The shift block adopts a block body having two free ends. An upper free end thereof props against a lower section of the inner part that is exposed from a bottom port of the controller; a lower free end thereof props against the peripheral wall of the spool disk and engages with the ratchets on the peripheral wall.

Accordingly, by means of the rotative spool disk disposed at the inferior portion of the base of the stem, a disk cord that connects to the upper accommodation could be wound around the spool disk. Wherein, the rotation of the spool disk is determined by the buckle controlling the controlling device to trigger the shift block to engage with the ratchets on the peripheral wall of the spool disk. Thereby, the rotation of the spool disk would prompt the disk cord to be reeled. Thus, the support could stop at any position when the umbrella is closed. As a result, users would not be hurt since the controlling device prevents the speedy spreading of the umbrella support via the elasticity generated by the support spring.

Moreover, the inner part is a middle component that is composed by the front body, the rear body, and the spring. Wherein, the inner part could be longitudinally compressed and deformed, and the front and the rear bodies are connected by the spring. As a result, the component capable of being longitudinally compressed and deformed does not require an accurate assemblage, especially to the dimension of the controller and buckle. Accordingly, a convenient assemblage is achieved, and the yield rate is also enhanced.

Further, since the end section of the notch at the side wall of the controller is formed as a through notch, the through notch and the hollow pipe of the controller can be communicated. Therefore, the disk cord could be set in the through notch to prevent from scraping against the edge of the notch. Thus, the disk cord would not be readily lodged or damaged to affect the operation of opening the umbrella.

DETAILED DESCRIPTION OF THE PREFERRED EMBODIMENTS

Figure 1:
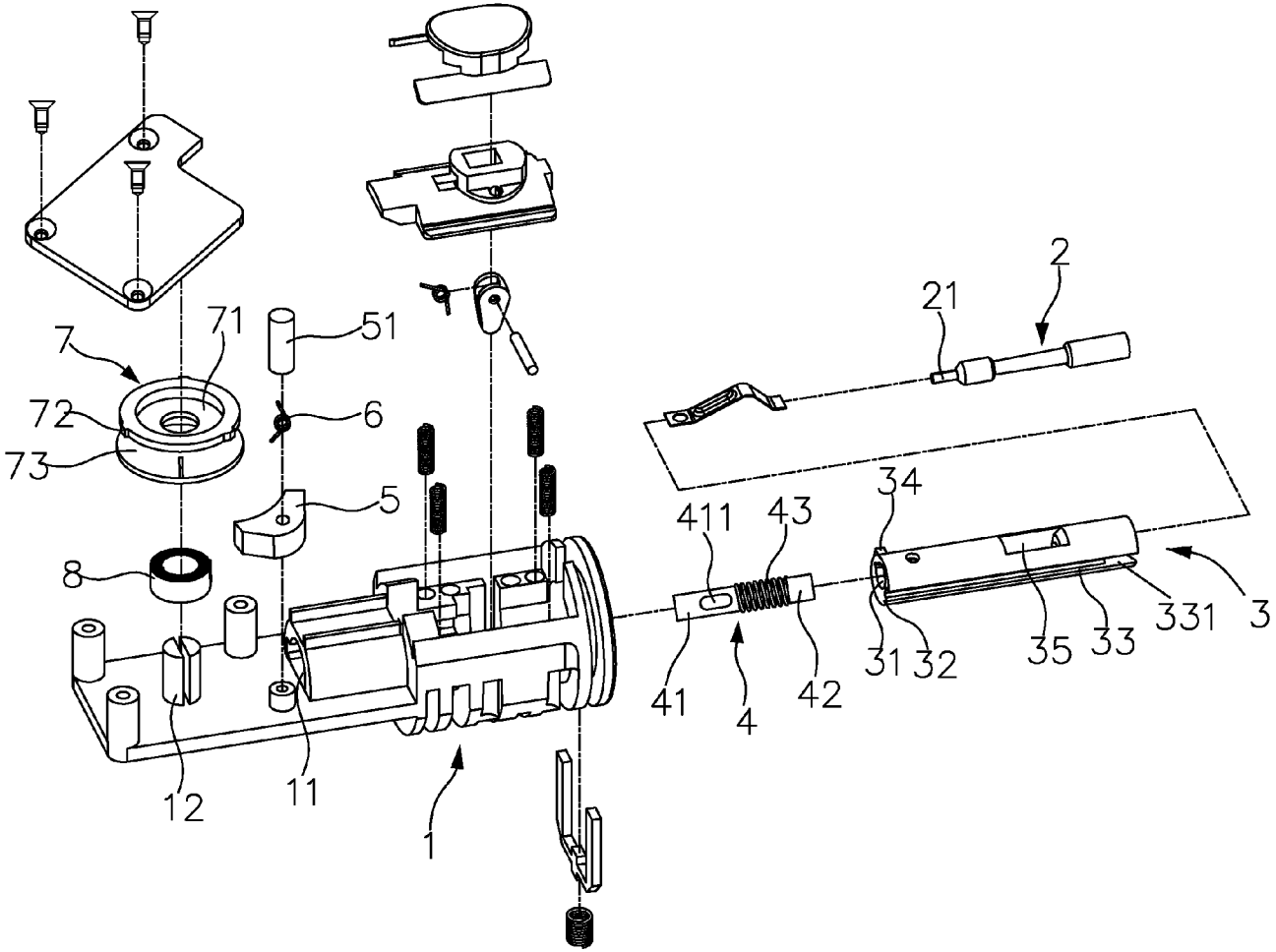
FIG. 1 is an exploded view showing the present invention.

FIGS. 1 to 8 disclose a controlling device for an umbrella support in time of closing. The disclosure would cooperate with a base 1 of an umbrella stem. A buckle 2 is pivotally inserted into the base. Characterized in that, a controlling device controlled by the buckle 2 is mounted on a higher portion of the base 1. The controlling device includes a controller 3 and an inner part 4 of the controller. The controlling device of the present invention further includes a shift block 5, a torsion spring 6, a spool disk 7, a spiral spring 8, and a disk cord 9.

The base 1 is fixed in the stem. An aperture 11 is axially disposed on the higher portion of the base, the inferior portion of the base is formed as a fixing portion, and a spindle 12 is longitudinal disposed thereon. Moreover, a cooperating portion for a button and a locating portion for a lower accommodation are longitudinally disposed at the higher portion of the base 1. The assemblage of the cooperating and locating portions is known by those skilled in the art and is herein omitted.

Figure 8:
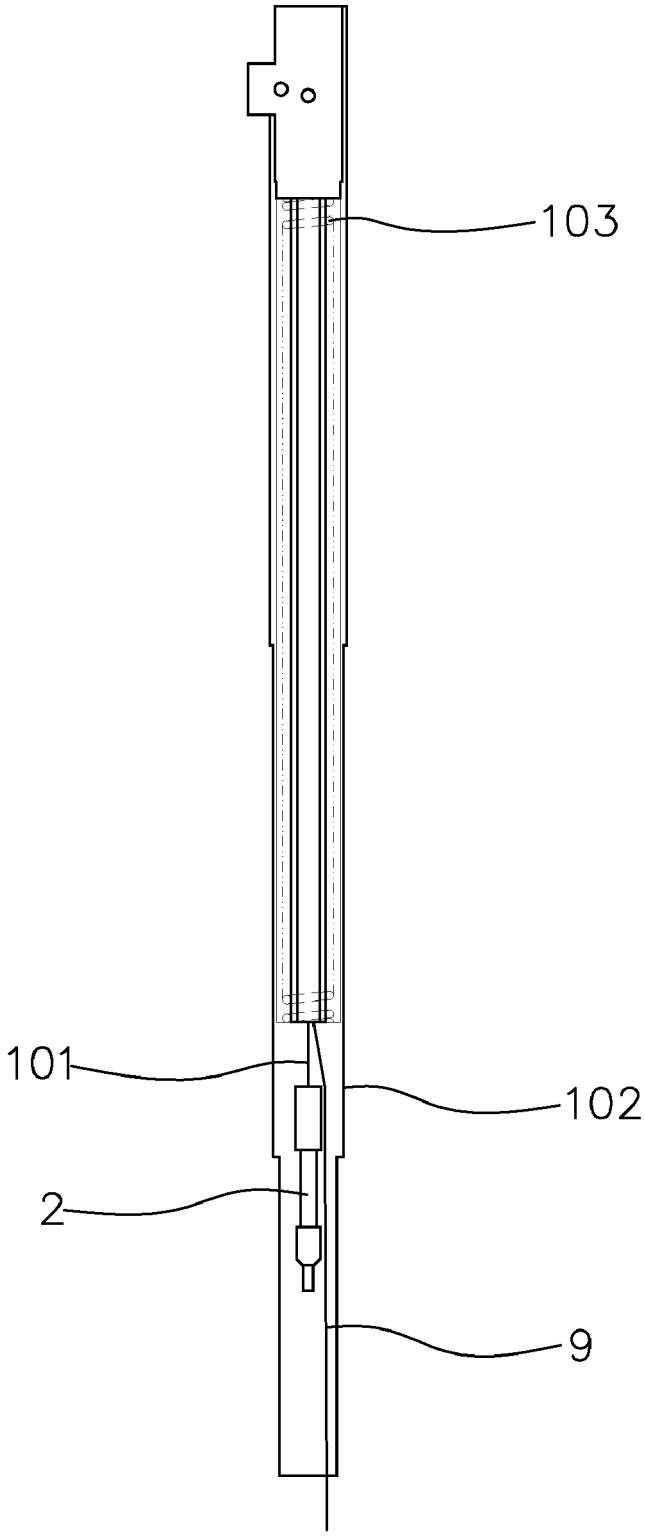
FIG. 8 is a schematic view showing the cooperation of the present invention and the support.

A tail of the buckle 2 connects to a main cord 101 (as shown in FIG. 8). The other end of the main cord 101 is fixed to the lower accommodation (the assemblage of the aforementioned elements is known by those skilled in the art and is herein not shown). A crown of the buckle 2 is formed as a necking for a button to engage with, and a needle 21 is onward and extensively formed at the crown of the buckle 2 and is preferably contact with the inner part 4.

Figure 2:
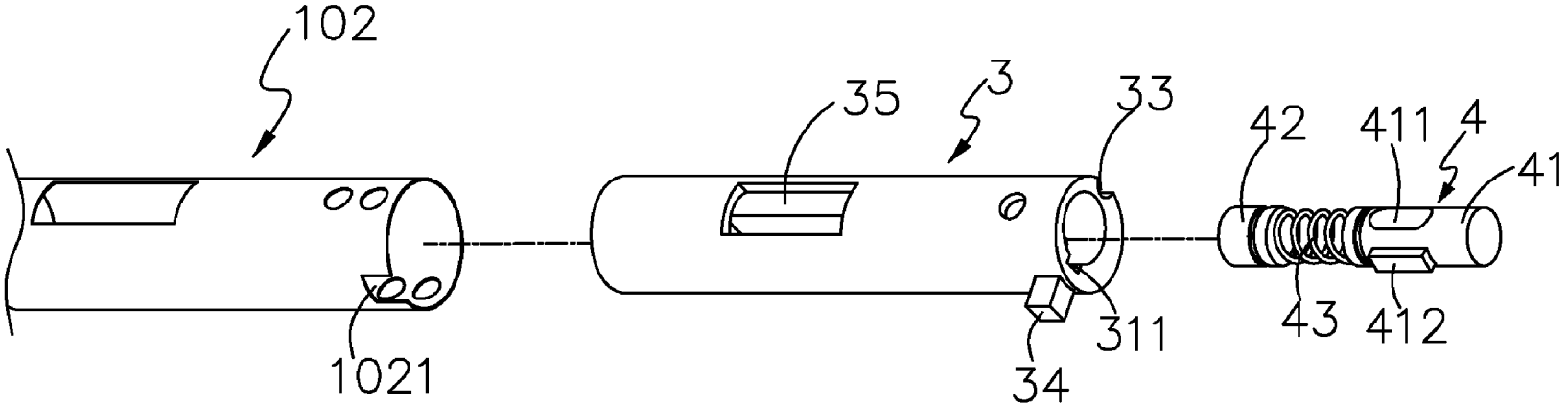
FIG. 2 is an exploded view showing the controlling device of the present invention.
Figure 3:
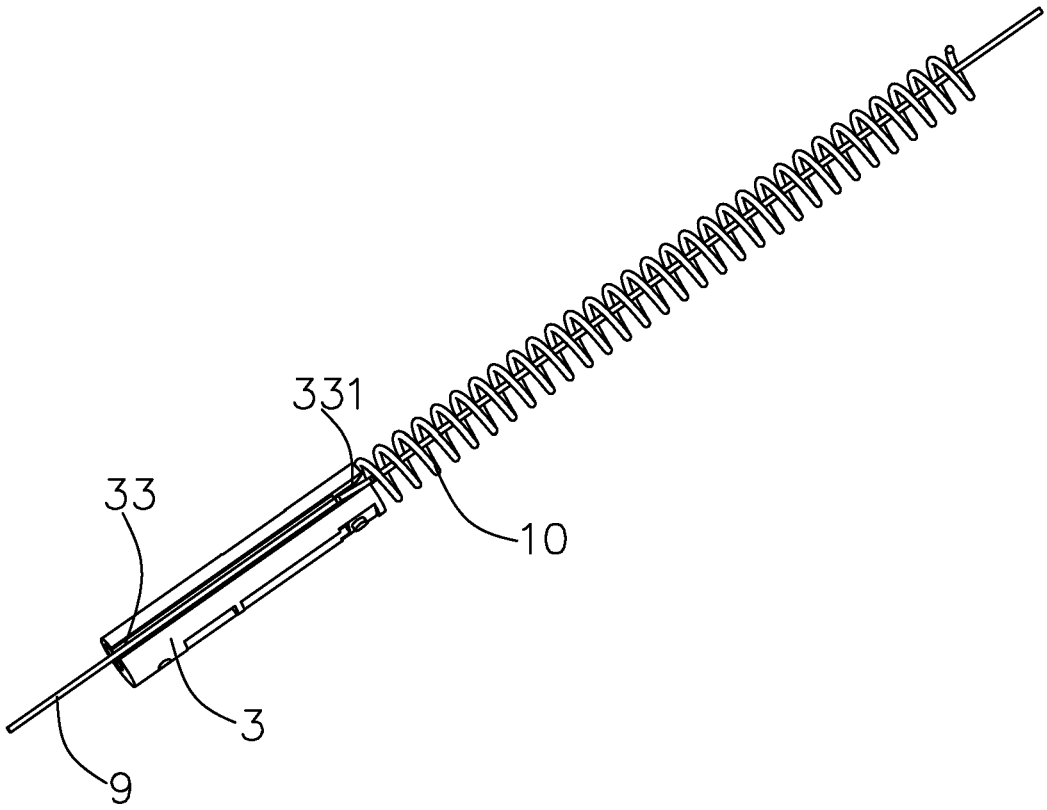
FIG. 3 is a schematic view showing the cooperation of the controller and the disk cord.
Figure 5:
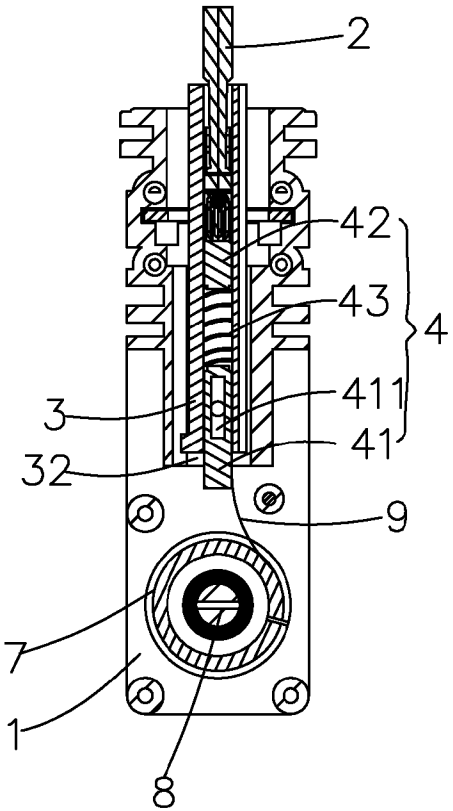
FIG. 5 is a cross-sectional view showing the present invention.

Referring to FIG. 2, the controller 3 adopts a tubular component that is fixed in the longitudinal aperture 11 of the base 1. A middle portion of the controller is axially formed by a hollow pipe 31 for the buckle 2 to protrude thereto and for the inner part 4 to be received therein. A window 35 is defined on a side wall of the controller 3 for a button to insert and engage with the buckle 2. Additionally, a notch 33 that thoroughly penetrates the other side wall of the controller 3 is defined for the disk cord 9 to pass through. Referring to FIG. 3, an end section of the notch 33 that contacts the propelling spring 10 is manufactured as a through notch 331 that is in communication with the hollow pipe 31 of the controller. Therefore the disk cord 9 could be set in the through notch 331 to prevent from scraping against the edge of the notch 33. Thus, the disk cord 9 would not be readily lodged or damaged. In order to superiorly prevent the disk cord 9 from being damaged, two edges of the notch 33 are preferably constructed by curved surfaces. A guiding slot 311 is disposed below an inner wall of the hollow pipe 31.

The inner part 4 adopts a tubular component flexibly disposed under the hollow pipe 31 of the controller 3. The inner part 4 comprises a front body 41, a rear body 42, and a spring 43. The front body 41 and the rear body 42 are connected by the spring 43, thereby forming a middle portion allowable to be longitudinal compressed and deformed. As a result, the inner part 4 does not require an accurate assemblage, especially to the dimension of the controller 3 and buckle 2. Accordingly, a convenient assemblage is achieved, and the yield rate is also enhanced. Further, a long opening 411 is radially defined on the front body 41 for a fixing pin to penetrate therethrough. Whereby, the inner part 4 is fixed in the controller 3, so that the inner part 4 would move forward and backward in the controller 3 via the long opening 411. A guiding block 412 is defined on a correspondent exterior wall of the front body 41 of the inner part 4 to cooperate with respect to the guiding slot 311. Thus, the controller 3 would achieve an accurate assemblage, which enhances the convenience of assembling.

The spool disk 7 adopts a plate component that defines a middle sink 71 thereon. At least four ratchets 72 are defined on a peripheral wall of the spool disk, and the peripheral wall is entirely embraced by a spool groove 73. Moreover, the spool disk 7 is pivotally disposed on a spindle 12 that is protruded at an inferior portion of the base 1. The spiral spring 8 is disposed in the middle sink 71 of the spool disk 7, which is formed as a circular-type sink. Two ends of the spiral spring 8 are respectively installed on the spindle 12 and a slot wall of the middle sink 71 of the spool disk 7. Thereby, an elastic driving force is generated to drive a rotation of the spool disk 7 surrounding the spindle 12.

The shift block 5 adopts a block body having two free ends. The middle portion of the shift block 5 is rotatively mounted on the base 1 via a pin shaft 51 and is disposed between the bottom of the bottom port 32 of the controller 3 and the spool disk 7. The shift block 5 and the pin shaft 51 are engaged with a torsion spring 6, so that the shift block 5 would possess a continuous torsion to contact the spool disk 7. An upper free end of the shift block 5 props against a lower section of the inner part 4 that is exposed from a bottom port 32 of the controller 3. A lower free end of the shift block 5 props against the peripheral wall of the spool disk 7 and engages with the ratchets 72 on the peripheral wall.

One end of a disk cord 9 is fixed on the spool disk 7 and wound around the spool groove 73 of the spool disk 7, and the other end thereof passes through the notch 33 of the controller 3 for being connected to an upper accommodation of the umbrella.

Referring to FIG. 2, a fixing opening 1021 is defined underneath the support 102; accordingly, a fixing block 34 is correspondingly disposed on the outer wall at the bottom of the controller 3. Therefore, the controller 3 could be precisely mounted in the support 102.

Figure 4:
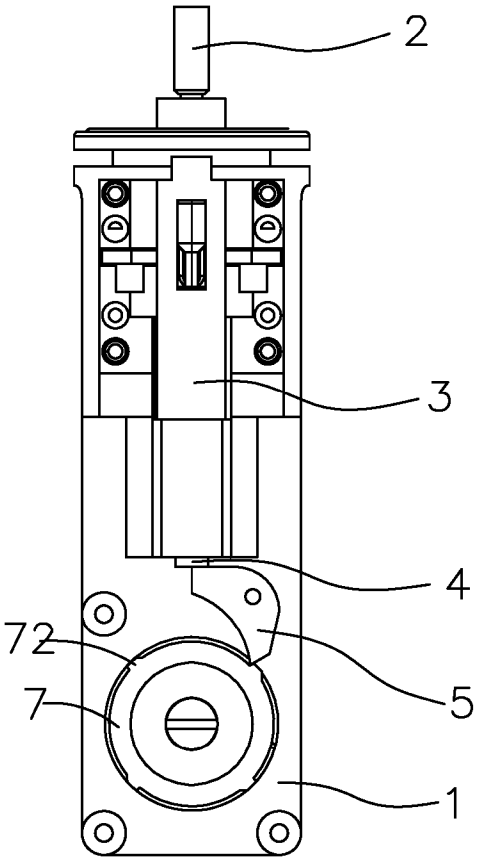
FIG. 4 is a schematic view showing the present invention.
Figure 7:
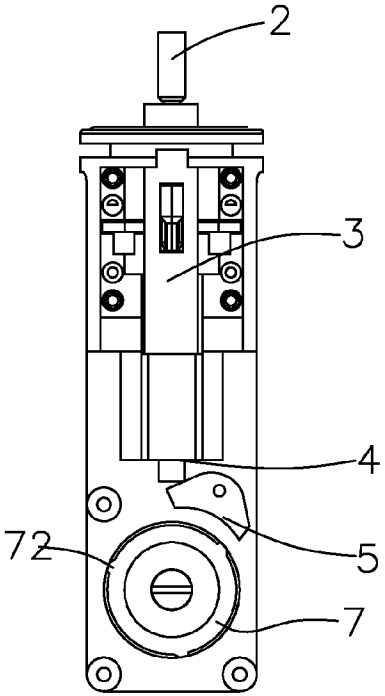
FIG. 7 is a schematic view showing the present invention in closing.
Figure 6:
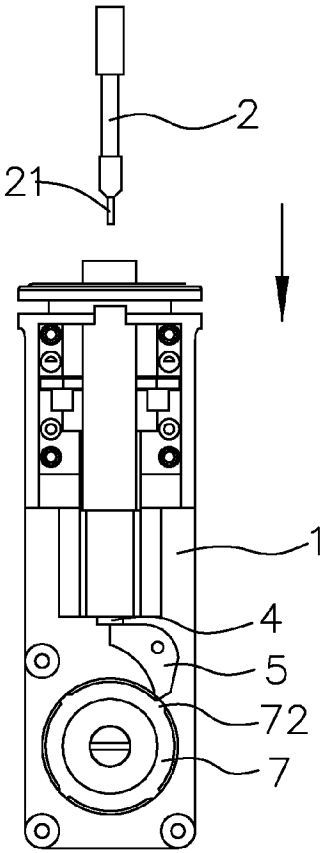
FIG. 6 is a schematic view showing the present invention to be closed.

Referring to FIG. 4, when the umbrella is opened, the top portion of the support 102 would not be inserted into the base 1. The lower free end of the shift block 5 would contact the peripheral wall of the spool disk 7 to engage with the ratchets 72 thereon so as to impede the rotation of the spool disk 7.

Further referring to FIGS. 5 to 8, when the umbrella is closed, the support 102 would be inserted into the base 1. The buckle 2 would penetrate through the top part of the hollow pipe 31 of the controller 3, and the lower tip of the needle 21 would be downwardly set into the hollow pipe 31 of the controller 3 until it props against the crest of the rear body 42 of the inner part 4. Thereby, the inner part 4 moves downwardly so as to press the upper free end of the shift block 5 for moving downwardly. By means of the leverage, the lower free end of the shift block 5 would be raised for departing from the ratchets 72 on the peripheral wall of the spool disk 7. Whereby, the spool disk 7 would be rotated round the spindle 12 via the spiral spring 8, so that the disk cord 9 would wind around the spool groove 73 of the spool disk 7 (as shown in FIG. 1). Once users loosen their grips off the support 102, the support 102 would rebound via the elasticity generated by the propelling spring 10. Wherein, the buckle 2 is drawn out from the controller 3, and the shift block 5 loses its propping force to engage with the ratchets 72 on the peripheral wall of the spool disk 7 again via the torsion spring 6, thence preventing the support 102 from a speedy springing back. As a result, the support 102 could halt at any position while closing the umbrella. Therefore, users could avoid the damage resulted from the fast spreading of the umbrella through the bounce of the propelling spring.

We claim:

1. Control device adapted for collapsible umbrella including:

a base;

a buckle removably inserted into said base; a controlling device, controlled by said buckle, mounted fixedly on a higher portion of said base, a spool disk, longitudinally rotated along with said base being positioned on an inferior portion of said base;

a plurality of ratchets defined on a peripheral wall of said spool disk and said peripheral wall embraced by a spool groove;

one end of a spiral spring fixed on said base, and the other end thereof fixed on said spool disk, for generating an elastic driving force to drive said spool disk;

a shift block disposed on said base disposed below said controlling device;

wherein, said shift block being controlled by a torsion spring for continuously possessing a torsion to contact said spool disk and to engage with said ratchets of said spool disk;

one end of a disk cord fixed on said spool disk and wound around said spool groove of said spool disk, and the other end thereof passing through said controlling device and said base for being connected to an upper accommodation of said umbrella;

when the umbrella is opened up:

a top portion of a support, upon which a controller of said controlling device is mounted, is not inserted into the base, and a lower free end of said shift block contacts the peripheral wall of the spool disk for engaging said ratchets thereon for restricting rotation of the spool disk; and when the umbrella is folded down:

the support is inserted into the base; the buckle penetrates through a top part of a hollow pipe of the controller, and a lower tip of a needle enters downwards into the hollow pipe of the controller until the needle props against a crest of a rear body of an inner part, thereby, the inner part moves downwards for pressing an upper free end of said shift block for moving downwards; the lower free end of said shift block is, by leverage, raised for departing from the ratchets on the peripheral wall of the spool disk, and the spool disk rotates round the spindle via the spiral spring for the disk cord to wind around the spool groove of the spool disk.

2. The controlling device as claimed in claim 1, wherein, said controller is disposed within said higher portion of said base, and said inner part is pivotally disposed at a bottom of said controller, so that said buckle is inserted from a top of said controller to prop against said inner part, and an underside of said inner part flexibly props said shift block.

3. The controlling device as claimed in claim 2, wherein, said controller adopts a tubular component, and a middle portion thereof is axially formed by a hollow pipe; a window is defined on a side wall of said controller for a button to insert and engage with said buckle, and a notch that thoroughly penetrates the other side wall of said controller is defined thereon for said disk cord to pass through.

4. The controlling device as claimed in claim 3, wherein, an end section of said notch at said top of said controller is manufactured as a through notch that is in communication with said hollow pipe of said controller.

5. The controlling device as claimed in claim 3 or 4, wherein, two edges of said notch are constructed by curved surfaces.

6. The controlling device as claimed in claim 2, wherein, said inner part is composed of a front body, a rear body, and a spring; said front body and said rear body are connected by said spring, thereby forming a middle portion capable of being longitudinal compressed and deformed; a long opening is radially defined on said front body.

7. The controlling device as claimed in claim 1, wherein, an aperture is axially disposed on said higher portion of said base, said inferior portion of said base is formed as a fixing portion, and a spindle is longitudinally disposed thereon for said spool disk to mount.

8. The controlling device as claimed in claim 1, wherein, a tail of said buckle connects to a main cord, a crown of said buckle is formed as a necking for a button to engage with, and a needle is onward and extensively formed at said crown of said buckle.

9. The controlling device as claimed in claim 8, wherein, a guiding slot is disposed at an under inner wall of said hollow pipe of said controller, and a guiding block is defined on an exterior wall of said inner part for fitting with said guiding slot.

10. The controlling device as claimed in claim 8, wherein, said inner part adopts a tubular component flexibly disposed to fit with a lower part of said hollow pipe of said controller, and a side wall of said inner part further provides with a long opening thereon.

11. The controlling device as claimed in claim 1, wherein, the spool disk adopts a plate component that defines a middle sink; said spool disk is pivotally disposed on a spindle that is protruded at an inferior portion of said base; said spiral spring is disposed in said middle sink of said spool disk; two ends of said spiral spring are respectively installed on said spindle and a slot wall of said middle sink of said spool disk.

12. The controlling device as claimed in claim 1 or 2, wherein, said shift block adopts a block body having two free ends; an upper free end thereof props against a lower section of said inner part that is exposed from a bottom port of said controller; a lower free end thereof props against said peripheral wall of said spool disk and engages with said ratchets on said peripheral wall.

* * * * *